United States Patent [19]

Usher

[11] Patent Number: 4,793,275

[45] Date of Patent: Dec. 27, 1988

[54] MARINE HAZARDOUS OFF-LOADING SYSTEM

[76] Inventor: David Usher, 16400 N. Park Place #1202, Southfield, Mich. 48071

[21] Appl. No.: 658,639

[22] Filed: Oct. 9, 1984

Related U.S. Application Data

[63] Continuation of Ser. No. 549,323, Nov. 7, 1983, abandoned, which is a continuation of Ser. No. 36,760, May 7, 1979, abandoned.

[51] Int. Cl.[4] ..... B63B 27/00

[52] U.S. Cl. ..... 114/270; 248/649; 414/139.4

[58] Field of Search ..... 414/137, 138, 735; 248/647, 649, 650, 206.5, 500; 114/31, 32, 85, 270; 182/141; 180/9.52; 254/102, DIG. 2

[56] References Cited

U.S. PATENT DOCUMENTS

| | | | |
|---|---|---|---|
| 2,831,589 | 4/1958 | Way | 414/735 |
| 2,908,472 | 10/1959 | McDonald | 248/649 X |
| 3,310,263 | 3/1967 | Cavanaugh | 248/649 |
| 3,458,173 | 7/1969 | Kornovich et al. | 254/DIG. 2 |
| 3,651,796 | 3/1972 | Nelson | 248/500 |

FOREIGN PATENT DOCUMENTS

| | | | |
|---|---|---|---|
| 669772 | 10/1964 | Italy | 180/9.52 |

*Primary Examiner*—Sherman D. Basinger
*Attorney, Agent, or Firm*—Lloyd M. Forster

[57] ABSTRACT

A hazardous off-loading system for emergency removal of cargo from a grounded or floundering ship which secures leveling platforms on the deck of the ship from which to implement cargo removal procedures serving to mount appropriate equipment such as a life support module for control housing and operator protection, a power pack with power generating and pumping capability, a mobile tractor for movement on deck and a mechanical robot arm.

11 Claims, 4 Drawing Sheets

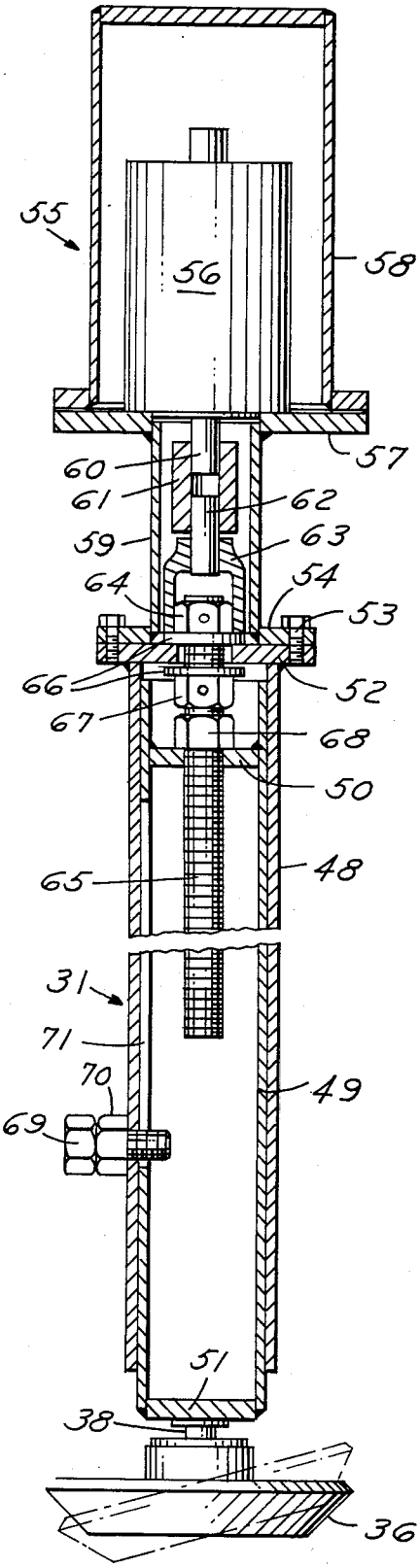
FIG. 8
FIG. 6
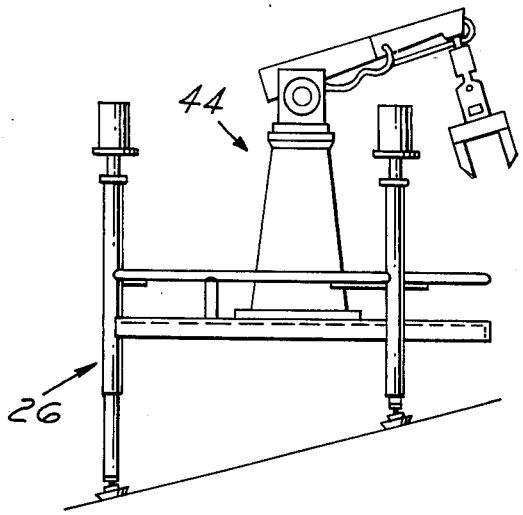
FIG. 7
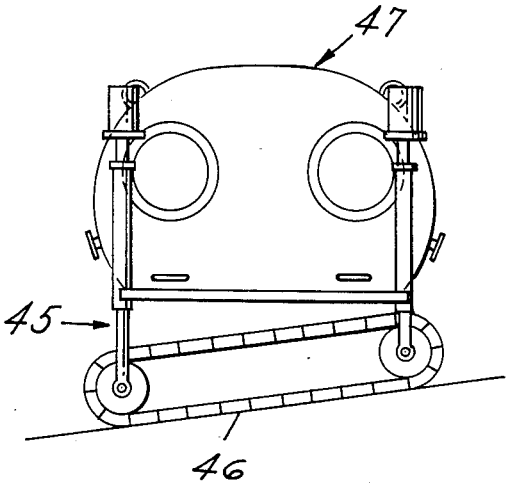

MARINE HAZARDOUS OFF-LOADING SYSTEM

This is a continuation of co-pending application Ser. No. 036,760, filed on May 7, 1979, and now abandoned, which is a continuation of Ser. No. 549,323, filed on Nov. 7, 1983, now abandoned.

BACKGROUND OF THE INVENTION

The devastating pollution of coastal waters such as occurred on the shores of Cape Cod, Mass. in December of 1976 while heavy weather pounded the tanker Argo Merchant to pieces and the breakup of the super tanker Amoco Cadiz off the coast of Brest, France in March of 1978 discharging 228,000 tons of oil onto the coastal waters and shoreline with relentless seas frustrating any conventional approach to pump out the holds with available high capacity pumps illustrate the problem calling for development of a system capable of operating under adverse weather conditions to remove cargo before complete ship breakup and discharge. In the professional business of marine pollution control, use of available high capacity pump equipment capable of transferring fluid cargo of distressed tankers to the holds of adjacent ships, shoreline receiving facilities, fillable rubber barges or like receiving means, has been frustrated by adverse weather conditions pointing out the need for development of an all weather system to make use of such equipment.

SUMMARY OF THE INVENTION

The key feature for the present solution is a leveling platform capable of providing a level work surface on the deck of a ship when inclined from grounding on a shoal or offshore bar.

The platform is secured to the deck through legs having magnetic feet and may be additionally secured through cables attached to adjacent ship structure. Self-leveling or manually controlled telescoping legs actuated electrically or hydraulically provide means for leveling the platform in any secured position on the deck. The leveling platform is basic to the system and may be advantageously employed for various component elements; for example, for a life support module for operators placed on deck along with the leveling platform by helicopter or loading boom from an adjacent vessel of opportunity; for mounting a power pack including pumps and power generating equipment in conjunction with the module; for open working platform from which men can direct a submersible pump down into the ship tanks; for robot arms to perform some of the pumping evolutions. In addition to serving as the power source for the pumps and legs, the power pack may be adapted to provide hydraulic power for operating the robot arms. Another form of equipment which may be employed in the system is a tractor type of vehicle for carrying the operator's module from tank to tank aboard a tanker. This may incorporate one or more robot arms designed to open "Butterworth" openings and hatch accesses as well as accessible shipboard valves.

The system is known as "Hazardous Offloading Systems-Emergencies" and by the abbreviation "HOS-E". In addition to emergency use on ships, the system also has application to the servicing of disabled offshore oil rigs damaged through explosion, storm or fire as in effecting repair and recovery of stored oil.

BRIEF DESCRIPTION OF THE DRAWINGS

FIG. 6 is a side elevation of a leveling platform adapted to mount a robot arm having different capabilities than shown in FIG. 4;

FIG. 7 is a side elevation of a leveling tractor type of vehicle adapted to mount a working module and;

FIG. 8 is an enlarged sectional side elevation of a typical telescoping leveling leg for installation in a leveling platform.

With reference to FIG. 1 a tanker 10 grounded off shore 11 is shown in a schematic perspective with a module platform 12 and power pack 13 on deck having pump lines 14 connected to a submersible pump through a hatch in the deck and to a discharge line 15 leading to a fillable rubber barge 16 which when filled as shown at 17 may be connected to a tow line 18 for removal by shallow draft vessel 19. An alternate discharge line 20 is shown for removing the cargo to a smaller tanker 21 taking fuel on board. Another alternate discharge line 22 is shown for temporary discharge into an emergency pond 23 provided by bulldozing a retaining wall 24 and lining with a suitable plastic material. An equipment loading and control helicopter 25 is maintaining surveillance of the off-loading operation.

With reference to FIGS. 2 and 3 a three legged loading platform 26 is constructed with a hexagonal frame 27 reinforced by triangular platform supporting bracing 28. A superimposed rail structure 29 is mounted on the hexagonal frame by three vertical supports 30 welded to the respective frame and rail structure and each of three telescoping legs 31 is adapted to support the platform by welded connections at 32 to the hexagonal frame 27 and vertically spaced welded connections 33 with the rail structure 29. As illustrated in FIG. 3, the telescoping extension 34 within the tubular housing 35 of each leg provides means for leveling the platform 26 through engagement of foot pads 36 with the tanker deck 37. The pads 36 are preferably constructed as magnetic elements swivelingly connected at 38 to the bottom of each leg extension 34.

With reference to FIG. 4 a leveling platform 26 such as illustrated in FIGS. 2 and 3 is adapted to mount the life support and control module 138, later described in detail, and is shown equipped with a robot arm 39 remotely controllable from within the module having an attachment means 40 engageable with a suitable fixed retaining element 41 on shipboard equipment 42 to prevent the platform from sliding down an inclined deck 37 as an auxiliary safety connection supplementing the magnetic gripping of pads 36. With such arrangement the platform and module with personnel inside may be lowered on the deck, leveled and secured while operators remain within the module.

With reference to FIG. 5 a similar leveling platform 26 is illustrated with power pack 43 mounted thereon which includes electrical and hydraulic power generating as well as high capacity pump equipment in an integral unit suitable for high speed pumping of fluid cargo.

With reference to FIG. 6 a leveling platform 26 is shown with a robot arm 44 mounted thereon which may be employed to perform many remote controlled work operations such as temporarily holding of heavy equipment, manipulation of valves, nuts, bolts, ratchets and the like, holding of hose for hydraulic cargo discharge and similar operations while the operators are protected within their control module or even monitoring the robot from a hovering helicopter.

FIG. 7 illustrates somewhat schematically a mobile platform 45 equipped with caterpillar drive 46 and adapted in this case to mount a control module 47.

With reference to FIG. 8 a typical leveling leg 31 includes an outer cylindrical casing 48, a telescoping inner tube 49 having an upper end plate 50 and a lower end plate 51 welded therein, the latter supporting a swivel mounting 38 for the foot pad 36. A mounting plate 52 is welded to the upper end of the outer casing 48 the flanges of which are bolted at 53 to a mounting plate 54 for the power actuating head 55 comprising a motor 56 mounted on plate 57 within housing 58. Casing 59, having ends respectively welded to plates 54 and 57, encloses a drive shaft 60 coupled by sleeve 61 and shaft 62 to an adapter socket head 63 for driving a nut 64 pinned to the upper end of a jack screw 65 rotatable within a threaded aperture through the plate 50. A pair of thrust washers 66 engaging either side of the plate 52 and a lower nut 67 pinned to the jack screw 65 serve to accommodate rotation of the jack screw within plate 52 in fixed axial position relative thereto established by the thrust washers 66. Within an upper limit established by stop nut 68, the jack screw 65 is thus adapted to actuate the inner sleeve 49 in telescoping relation within the outer casing 48 to adjust extension and effective length of the platform leg. A bolt 69 extending through a nut 70 secured to the outer casing 48 over an aperture therethrough engages a vertical guide slot 71 in the inner sleeve to maintain telescoping axial movement without relative rotation between the outer casing 48 and sleeve 49. The motor 56 may be hydraulic or electrical depending on the availability of the power source for actuating same. At least some of the motors, associated with the platforms to be leveled before the power pack is operative, are battery operated electric motors. Such units may be adapted for automatic self-leveling through gravity sensitive controls mounted on the platform which per se are known in the art.

Figure 1:
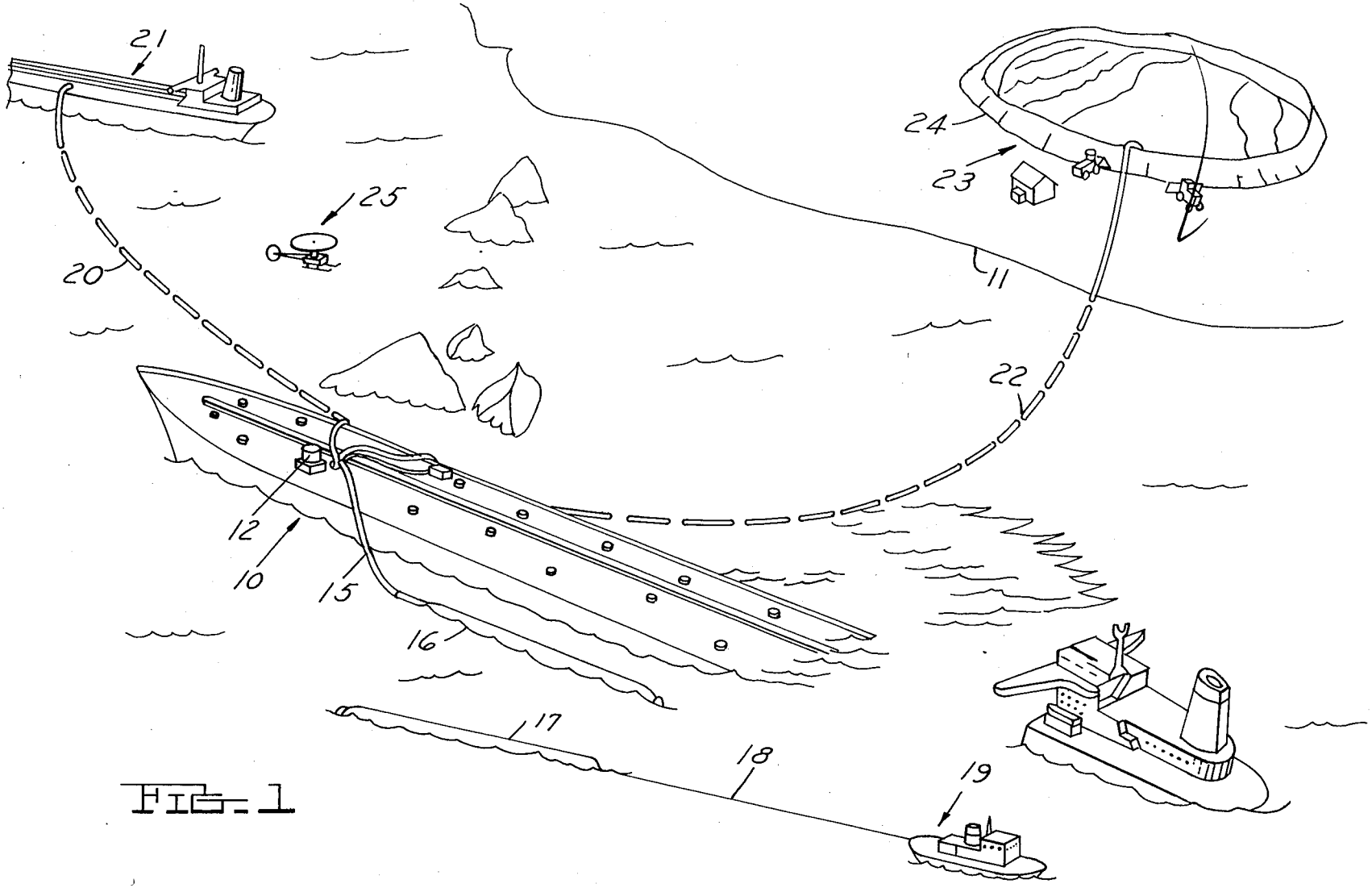
FIG. 1 is a schematic view of a grounded tanker showing alternate pump lines and off-loading facilities for receiving the cargo from the striken ship.
Figure 2:
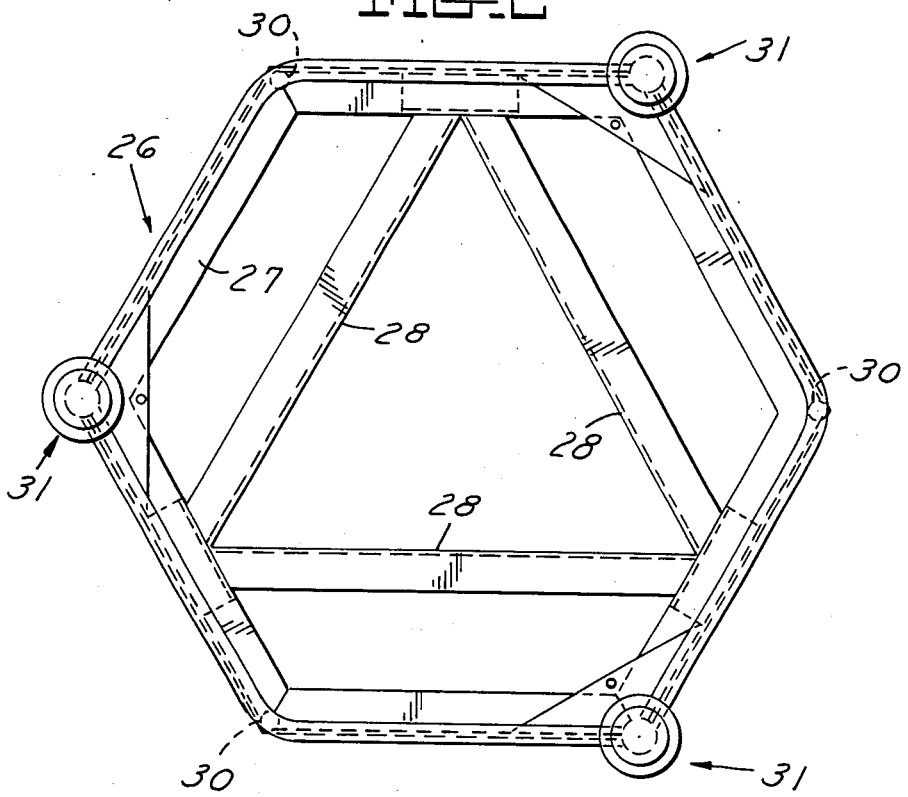
FIG. 2 is a plan view of a leveling platform constructed in accordance with the present invention.
Figure 3:
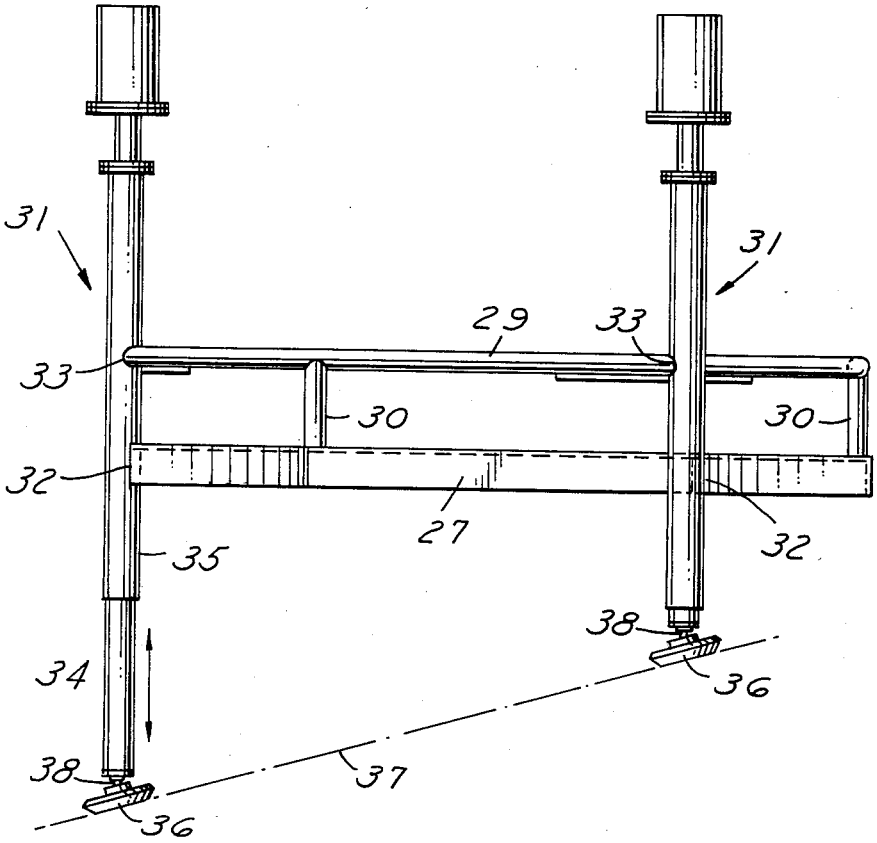
FIG. 3 is a side elevation of the leveling platform of FIG. 2.
Figure 4:
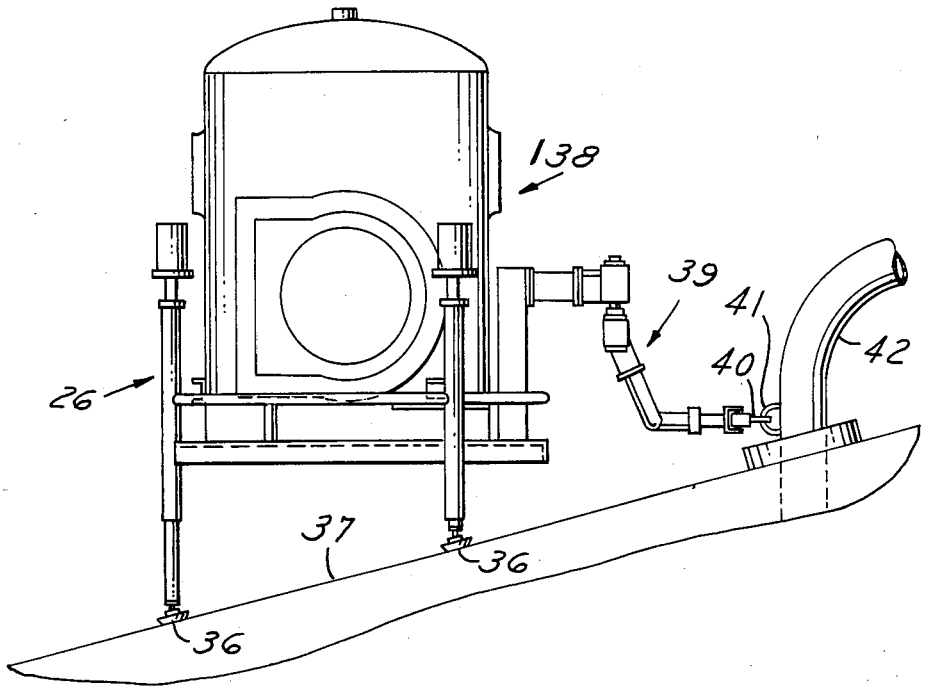
FIG. 4 is a side elevation of a leveling platform adapted to mount a life support control module and robot arm.
Figure 5:
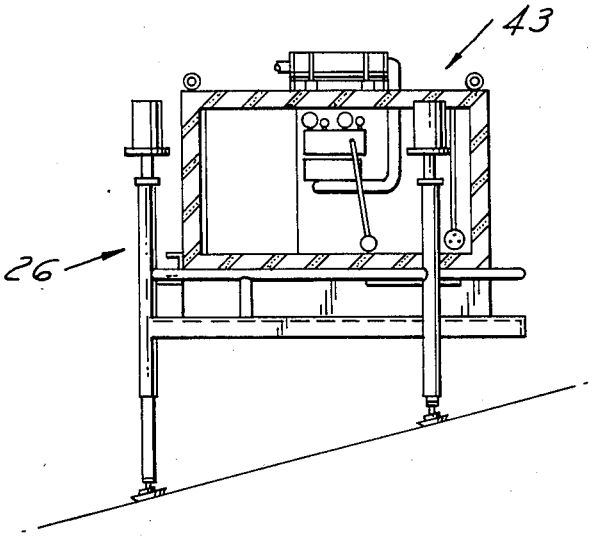
FIG. 5 is a side elevation of a similar leveling platform adapted to mount a typical power pack.

It will be understood that many adaptations and modifications of the system employing leveling platforms as basic key elements will be possible. A command control and life support module on one platform and a power pack on another will normally be employed in this hazardous off-loading system for emergency use. Auxiliary units such as robot arms and mobile tractors may be optionally employed in the system where circumstances warrant. Pumping equipment may be mounted on the three legged platform of FIGS. 2 and 3 on a tripod with a grip hoist attached to the pump for lowering into a Butterworth opening or hatch access.

Typical specifications for the construction of a leveling platform mounted module would include stainless steel platform; hydraulically operated extendible legs; positioning and securing devices consisting of magnets and cables; a fiberglass reinforced plastic shelter survival control module for three persons; and a waterproof entrance hatch. Features would include automatic and manual self-leveling; temporary shelter for inclement weather; monitoring of position and movement of vessel and weather at the scene. Safety equipment would include lifting eyes accessible in any position on the platform or in the water; a quick release system such as explosive bolts to separate the module from the platform; life preservers with lights and whistles attached; inflatable bags for floatation and proper stability of the module if set free in a sea or dropped; fire extinguishers; explosimeter and toxicity measuring equipment; cold weather survival suits if climate requires; seat belts and shoulder harnesses; air bags for personnel safety; ring life buoys; and first aid kit. Additional equipment may include barometer; anemometer; wind direction indicator; two-way remote radio; remote electronic control system; pelorus; emergency rations; chronometer, and air breathing equipment.

The power pack may consist of already available integrated high capacity power generating and pumping equipment. Auxiliary equipment such as robot arms and mobile units may of course be supplemented as well as other equipment useful in various other circumstances. The key element in the system is the leveling platform which will accommodate deck inclination and permit required personnel and equipment to be securely and operatively mounted on shipboard under virtually all weather conditions.

What is claimed is:

1. A hazardous off-loading system for emergency use in unloading the cargo of disabled ships comprising a deck mountable leveling platform, a personnel control and survival equipped module on said platform, substantial displacement means for post-placement leveling of the platform after it has been deposited and released with its full weight on a support surface, power generating and power actuated means for effecting said leveling of the platform, said respective means to accommodate initial deck inclination and/or re-leveling after deck shifting, and a secure base on said platform for said module, personnel and equipment to be employed in the unloading operations.

2. A system as set forth in claim 1 including said leveling platform with a work performing robot mounted thereon.

3. A system as set forth in claim 2 including a mobile tractor unit with means for accommodating ship deck traversal.

4. A system as set forth in claim 1 including remote controllable robot attachment means for securing said platform to ship board equipment on an inclined deck.

5. A system as set forth in claim 1 wherein said platform includes adjustable leveling leg means.

6. A system as set forth in claim 5 wherein said adjustable leg means includes telescoping elements.

7. A system as set forth in claim 6 including jack screw means for actuating said telescoping elements.

8. A system as set forth in claim 7 including power operated motor means for actuating said jack screw means.

9. A system as set forth in claim 5 including swiveledly mounted magnetic foot means mounted at the lower end of said leg means.

10. A system as set forth in claim 1 wherein said platform is supported on three triangularly spaced adjustable leg means.

11. A system as set forth in claim 10 including a hexagonal frame for mounting said three leg means.

* * * * *